United States Patent [19]

Krosby

[11] Patent Number: 4,663,781

[45] Date of Patent: May 12, 1987

[54] OVERCOAT COMBINED WITH LINING TRANSFERRABLE TO LEG WARMER

[76] Inventor: Erling R. Krosby, 13002 Binley Ct., Houston, Tex. 77077

[21] Appl. No.: 851,809

[22] Filed: Apr. 14, 1986

[51] Int. Cl.[4] ..... A41D 3/02

[52] U.S. Cl. ..... 2/86

[58] Field of Search ..... 2/82, 85, 86, 93, 97

[56] References Cited

U.S. PATENT DOCUMENTS 1,330,152 2/1920 Wilson ..... 2/85

FOREIGN PATENT DOCUMENTS 341784 10/1959 Switzerland ..... 2/86

*Primary Examiner*—Doris L. Troutman

*Attorney, Agent, or Firm*—Kenneth H. Johnson

[57] ABSTRACT

An overcoat combined with a lining which can be converted to leg warmer by having a slit back on the lining and the edges of the slit and the vertical edges on the lower front part of the lining is provided with zipper halfs or other adequate fastenings to the effect that the lining when the zipper halfs or the fastenings are closed will at the lower part form two pipes similar to overtrousers. When the lining is open the lining will function as a usual lining and can be taken off as a garment belonging to the overcoat. The transverse edges on the lower and outside part of the lining are provided with bands and buckle and the band runs in a runway formed by short bands. The bands can be shortened to the effect that the lower edges can be shortened and the openings of the pipes at the lower parts of the pipes can be made smaller so as to prevent cold air from access to the inner part of the pipes from below.

5 Claims, 2 Drawing Figures

OVERCOAT COMBINED WITH LINING TRANSFERRABLE TO LEG WARMER

The present invention relates to an outer garment having the nature of an overcoat combined with a lining which is given such a form that it can be converted to leg warmer or trousers for protection of the wearer's legs against cold weather.

In areas with cold winters people will be exposed to large variations in temperature when they go from cold temperature outside to well heated rooms indoors and vica versa. Many use long underwear. However, this will be too warm indoors. The present invention has the purpose of solving that problem by giving full protection against the cold weather outside by having an overcoat with lining which can be converted to leg warmer, that easily can be taken off indoors.

DETAILED DESCRIPTION OF THE INVENTION

The present invention relates to an overcoat combined with a lining. The lining of the coat is for the part above the waistline formed as a usual lining The lining is however below the waistline designed in such a way that it can be converted to "trousers". The lining has a slit back and the edges of the slit and the front vertical edges of the lining are provided with a zipper or other adequate fastenings to the effect that the lining when the zipper or the fastening is closed will at the lower part form two pipes similar to trousers.

Therefore, in an open position the lining is functioning as a normal lining and to large extent look like a normal lining. However, the lining is usually not visible under the overcoat neither in closed or open position, especially if the overcoat does not have a slit back and the lining is not longer than the overcoat. However, the lining can be designed as full trousers extending down to the feet of the wearer as normal trousers. By opening the zippers or the fastenings the overcoat and the lining can be easily taken off and be put in a wardrobe. The overcoat and the lining can be used in an open position when the weather is not cold and be closed when it is cold. The lining can only be used in open position if the lining is not longer than the overcoat.

The conventional method of protecting the legs against cold weather is to use overtrousers used for skiing with the zippers at the outside. Most people would not like to use this type of overtrousers when dressed in suit because the overtrousers are a separate garment which must be taken off separately and be hung separately in the wardrobe when being indoors. Another invention is the German Pat. No. 689897 where the lower part of the overcoat has a separate cloth fixed to it, which can be converted to pipes by fixing the edge of the slit to the lower front of the overcoat. This conversion of the overcoat to some kind of leg warmer destroys the appearance of the overcoat and is not a good solution from an aesthetic viewpoint and is not on the market today for that reason. The Norwegian Pat. No. 33778 uses also the lower part of the overcoat to convert this to some kind of overtrousers. However, the invention uses another method to fix the lower part of the overcoat around the legs.

The present invention is different from the other inventions by using a combination of overcoat and lining and because the lining is specially designed as trousers where the "trousers" are open at the front and the inner side and the inner side of the "trousers" can be closed by zippers or other fastenings. By cutting the lining as trousers from the waistline and below it is comfortable to use in closed position. The above mentioned patents are different from the present invention because the pipes formed by the lower part of the overcoat is formed by fixing the lower edges of the slit at the front or at the outer side of the overcoat while the present invention fixes the edges of the slit and the edges of the front on the inner side of the formed pipes. Thereby can the lining in open position function and to a large extent look like a lining without having to button certain portion of the overcoat or certain cloths to the overcoat and the lining.

For further protection the edges of the pipes' lower opening can be provided with bands with a buckle, where the band is not fixed to the edges of the pipe, but will be kept in place by short bands fixed to the pipes so that they form a runway where the band with buckle can run freely to the effect that the band can be shortened and thereby reduce the periphery of the the opening of the lower part of the pipe and thereby reduce the amount of cold air that can enter into the pipes from below.

The overcoat with the lining will preferably be used together with long boots or knee-short stockings for further protection of the legs against cold weather, in case the lining is not made as trousers which reach down to the feet.

The purpose of the present invention is to abide with the recommendation of the doctors to be dressed light indoors in warm rooms and at the same time protect oneself against cold weather outside, which will reduce the number of times a person will catch cold and reduce the risk of arthritis caused by exposing the legs to strong cold temperatures.

The invention shall be described in more detail with reference to an example of the invention shown in a drawing.

Figure 1:
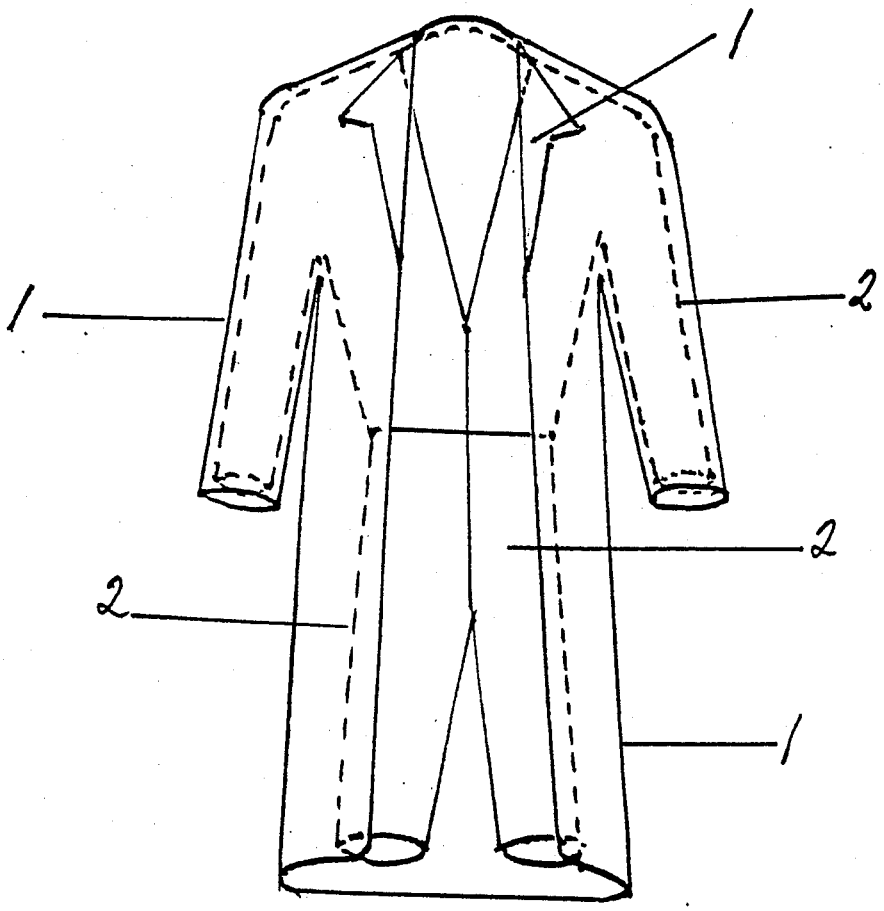
FIG. 1 shows the overcoat with lining in closed position.
Figure 2:
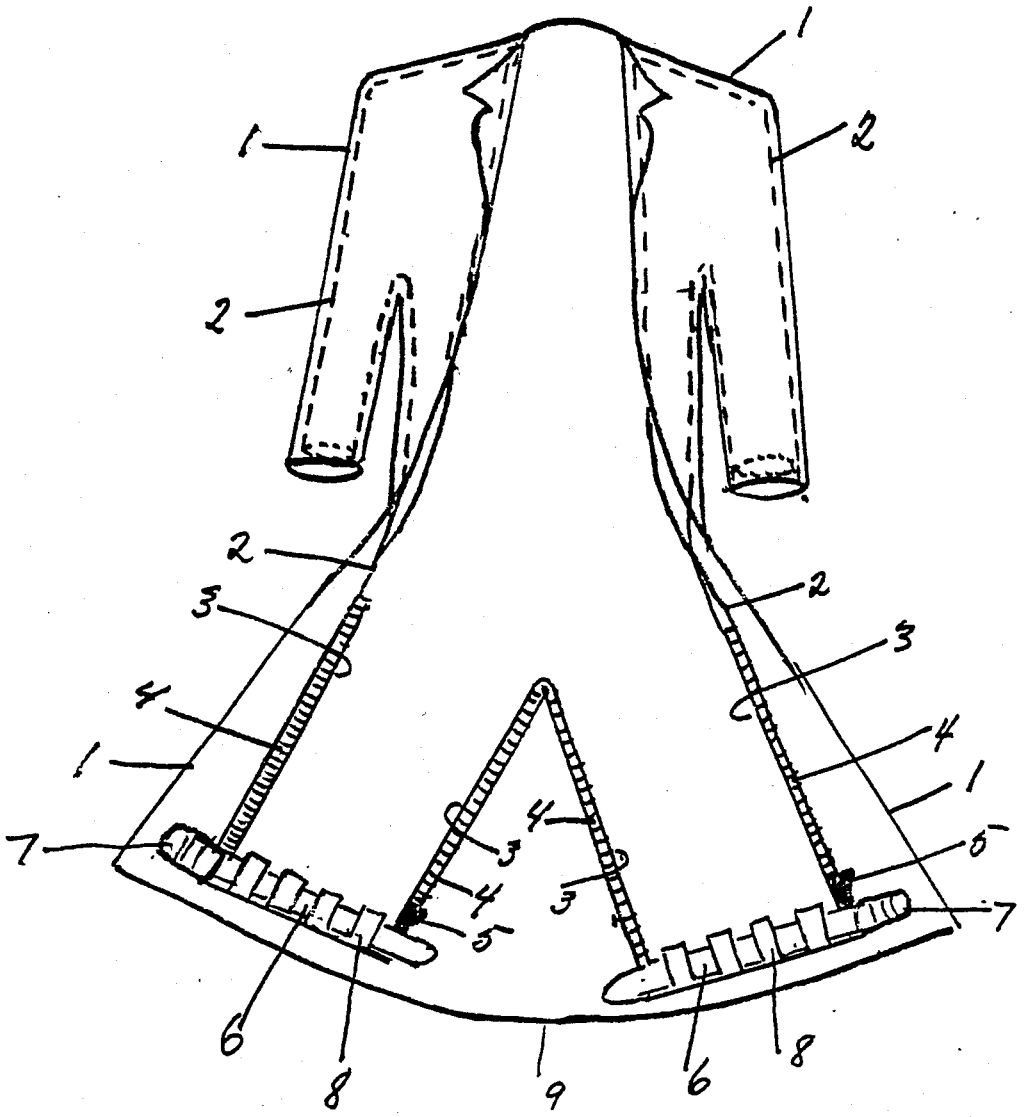
FIG. 2 shows the overcoat and the lining in open position.

The overcoat 1 can be sewn after any pattern. However, an overcoat without slit back will best fulfill the purpose of hiding the lining 2. The lining 2 can be fixed permanently to the overcoat or used loose with the overcoat. However, it is most advantageous to fix the lining so that the overcoat and the lining constitute one garment. Lining 2 is designed so that it will have the same form and function as trousers when the lower part of the garment is closed. On FIG. 2 the vertical edges on the slit and the edges on the front at the lower part of the lining 3 is provided with zipper halfs 4 which can be joined in a known way and can be closed by the zipper closer 5. Instead of zipper can be used any kind of adequate fastenings, e.g. buckles. At the lower edge of the lining is fixed a band 6 with buckle 7 which can run in a runway established by having short bands sewn on the lining on their transverse edges 8 to the effect that the band can be shortened and thereby reduce the periphery of the horizontal edges 9 on the lining.

The invention claimed is:

1. In combination an overcoat and a lining, said lining comprising an upper portion and a lower portion having a first elongated leg section and a second elongated leg section, said elongated leg sections extending distally from said upper portion and forming a crotch, said first elongated leg section having cooperating fastening means along opposed sides thereof, whereby engagement of said cooperating fastening means thereon forms a first pipe, said second elongated section having a cooperating fastening means along opposed sides thereof, whereby engagement said cooperating fastening means thereon forms a second pipe, said first and second elongated leg sections being further characterized and adapted such that the engaged fastening means of said first pipe are substantially juxtaposed to the engaged fastening means of said second pipe.

2. The combination according to claim 1 wherein cooperating fastening means each comprise a zipper half.

3. The combination according to claim 1 wherein means are provided about the distal end of each of said elongated leg sections to allow reduction of the periphery of the pipes formed therewith.

4. The combination according to claim 2 wherein means are provided about the distal end of each of said elongated leg sections to allow reduction of the periphery of the pipes formed therewith.

5. The combination according to claim 1 wherein said upper section has arms.

* * * * *